US009307808B1

(12) United States Patent
Lill

(10) Patent No.: US 9,307,808 B1
(45) Date of Patent: Apr. 12, 2016

(54) MAGNETIC BUCKLE ASSEMBLY

(71) Applicant: Duraflex Hong Kong Limited, Hong Kong (CN)

(72) Inventor: Edgar Lill, St. Nikolai/Sausal (AT)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 14/599,623

(22) Filed: Jan. 19, 2015

(51) Int. Cl.
*A44B 11/25* (2006.01)
*A44B 11/00* (2006.01)
*A44B 99/00* (2010.01)

(52) U.S. Cl.
CPC ..... *A44B 11/2584* (2013.01); *A44B 11/006* (2013.01); *A44B 99/00* (2013.01)

(58) Field of Classification Search
CPC ... A44B 11/258; A44D 2203/00; Y10T 24/32
USPC ..... 24/303
See application file for complete search history.

(56) References Cited

U.S. PATENT DOCUMENTS 2,648,884 A * 8/1953 Loofboro ..... A44C 5/2071 24/303
3,041,697 A * 7/1962 Budreck ..... A44B 15/002 24/303
5,664,298 A * 9/1997 Nessar-Ivanovic .. A44C 5/2071 24/303
6,292,985 B1 * 9/2001 Grunberger ..... A44B 11/2592 24/303
6,505,385 B2 1/2003 Grunberger
6,598,271 B2 * 7/2003 Nire ..... A41F 1/002 24/265 WS
6,606,767 B2 * 8/2003 Wong ..... A41F 1/006 24/303
6,857,169 B2 2/2005 Chung
7,496,994 B1 * 3/2009 Headley ..... A44C 5/2019 24/303
8,196,268 B1 * 6/2012 Placeres ..... A41F 1/002 24/303
8,359,716 B2 * 1/2013 Fiedler ..... A44B 11/25 24/303
8,914,951 B2 * 12/2014 Gaudillere ..... A44B 11/266 24/303
2012/0044031 A1 * 2/2012 Ninomiya ..... H01F 7/0263 335/219

* cited by examiner

*Primary Examiner* — Robert J Sandy
*Assistant Examiner* — Rowland Do
(74) *Attorney, Agent, or Firm* — Collard & Roe, P.C.

(57) ABSTRACT

A buckle assembly has male and female portions with magnets embedded in each portion. The male portion has a locking leg with a pawl at its end that seats within a corresponding locking groove having an insertion portion and a locking portion having a flange on the female portion when the male and female portions are placed together. When the male part is placed adjacent the female part, the magnets attract each other to force the locking leg through the insertion portion of the locking groove. The magnets are disposed laterally offset from each other when the locking leg extends through the insertion portion, so that the magnets to pull the male and female portions in opposing lateral directions to force the locking leg into the locking portion of the groove, causing the locking pawl to engage the flange and lock the male portion to the female portion.

9 Claims, 6 Drawing Sheets

MAGNETIC BUCKLE ASSEMBLY

BACKGROUND OF THE INVENTION

1. Field of the Invention

This invention relates to a two piece buckle assembly that is held together by magnets on both the male and female portions. In particular, the invention relates to a buckle assembly having laterally offset magnets on the male and female portions, so that the attraction between the magnets forces the male and female buckle portions together and slides them laterally (perpendicular to the pulling direction of the straps on each buckle) into a fully locked position so that locking legs on the male portion engage into locking slots on the female portion.

2. The Prior Art

It is known to place magnets in belt buckles in order to connect the two ends together in a simple manner. For example, U.S. Pat. No. 6,857,169 to Chung shows a buckle in which the male and female parts each have a magnetic element which attracts the two parts together. A hook element on the male part slides within a groove of the female part when the magnets are placed in alignment to keep the parts locked together.

This buckle has several drawbacks, however. In particular, the magnets are not fully molded within the buckle material and can easily fall out, thus eliminating the effectiveness of the buckle. In addition, loss of tension on the buckle straps can cause the buckle to inadvertently disengage because the magnets are offset from each other only in the longitudinal direction.

SUMMARY OF THE INVENTION

It is an object of the invention to devise a buckle in which the magnets are securely retained inside the male and female portions. It is another object of the invention to provide a buckle in which the male and female can be easily and securely joined together and held in place via the magnets.

These and other objects are accomplished by a buckle assembly comprising having a male portion and a female portion. Each of the male and female portions has an outer surface, an inner surface, two side edges and two ends. The side edges extend in a longitudinal direction and the ends extend in a lateral direction. There is a strap retaining bar disposed on one of the ends of each of the male and female portions so that two strap ends can be connected to each other by connecting the male and female portions together. The straps extend in the longitudinal direction and place tension on the buckle in the longitudinal direction.

There is a magnet disposed between the outer surface and the inner surface of each of the male and female portions. The magnet is completely embedded with the respective male or female portions so that it is not visible or removable. The magnets are oriented so that opposite poles face each other on the inner surfaces of the male and female portions, so that the inner faces of the male and female portions are attracted to each other.

On the male portion, there is at least one locking leg projecting from the inner surface. Each locking leg has a locking pawl extending from a distal end thereof. On the female portion there is at least one locking groove, the locking groove having an insertion portion extending through the inner surface, and a locking portion having a flange extending from the inner surface. The locking portion is disposed laterally adjacent the insertion portion. The locking groove is configured to correspond to the locking leg on the male portion, so that the locking leg can be inserted through the insertion portion and moved sideways (perpendicular to the longitudinal direction) into the locking portion where the pawl engages the flange. At this point the male portion will be firmly connected to the female portion.

Due to the magnets, placing the male part adjacent the female part causes the magnets to attract to each other to press the male portion to the female portion and force the at least one locking leg through the insertion portion of the locking groove. This eliminates the need for the user to have to align the locking leg or legs with the insertion grooves, as the attractive force of the magnets will automatically guide the legs into the grooves. In addition, the magnets are disposed laterally offset from each other when the locking leg extends through the insertion portion, so that the magnets to pull the male and female portions in opposing lateral directions to force the locking leg into the locking portion of the groove, causing the locking pawl to engage the flange and lock the male portion to the female portion. Thus, the magnets automatically perform the insertion and locking functions of the buckle. All that is needed from the user is to position the inner surface of the male portion adjacent the inner surface of the female portion until the magnets attract each other. At that point, the user can let go and the buckle portions will snap into place in the fully locked position. To release the buckle portions, the user needs to manually slide the male portion laterally relative to the female portion until the locking legs are disposed in the insertion portion of the locking groove, then the male portion can be pried up off of the female portion using the user's fingers until the magnets release.

To aid in the manufacturing process, each of the magnets is placed inside a retaining element, and the male and female portions are then molded around the respective retaining elements to seal the magnets within the respective portions. In one embodiment, the retaining elements are made of metal and the buckle portions are made of plastic. Alternatively, both the retaining elements and buckle portions are made of plastic. The retaining elements each have a slot or retaining feet for insertion and retention of the magnets. The retaining elements cover at least one surface of the magnets, so that during the molding process, the retaining elements can extend through one of the surfaces of the top and bottom portions without exposing the magnets. Alternatively, the retaining elements can be completely embedded within the mold material of the top or bottom portions and not be exposed at all.

In one embodiment of the buckle assembly, the ends of the male portion extend beyond and cover the ends of the female portion.

In another embodiment of the buckle assembly, there are four locking legs on the male portion and four grooves on the female portion. The four locking legs are disposed at each of the four corners of the male portion, to evenly distribute the locking force.

To aid in releasing the male portion from the female portion, one of the side edges of the male portion can extend beyond the corresponding side edge of the female portion when the male and female portions are locked together. This gives the user a lip to press up on when prying the two parts apart. This width difference can be created by an extension on the male portion, an indentation on the female portion, or both.

In order to keep a constant bias on the locking legs, the magnets are disposed offset from one another even when the male and female portions are in the fully locked position. This creates a constant lateral pressure on the locking legs so that there is no play within the locking slot so they do not inadvertently slide out of the locked position.

In another embodiment, the locking legs comprise two laterally extending legs that extend across the male portion at opposite longitudinal ends of the male portion. Each of these locking legs has two of the locking pawls. The female portion has two locking grooves that correspond in shape to the two locking legs. Each of these locking grooves extending laterally across the female portion and has two of the insertion portions and two of the locking portions, so that placing the locking legs into the insertion portions of the locking grooves and sliding the locking legs laterally forces the locking pawls into the locking portions to lock the male and female portions together.

The present invention provides a novel buckle in which the male and female portions can be securely locked together with little or no effort by the user.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
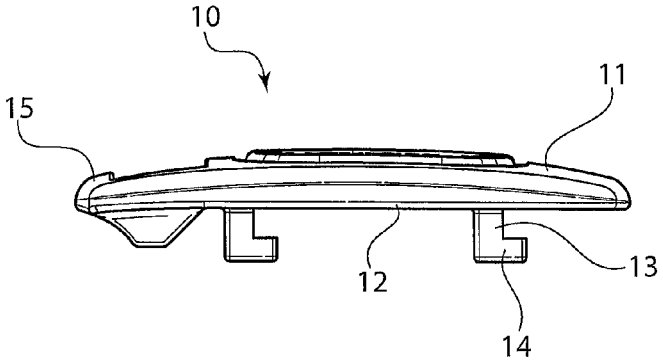
FIG. 1 shows a side view of the male portion of the buckle assembly according to the invention.
Figure 2:
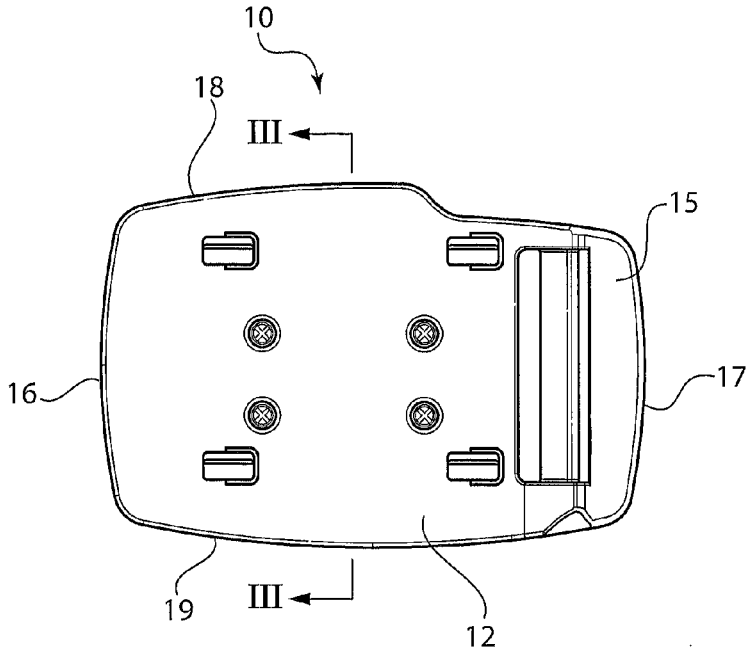
FIG. 2 shows a bottom view of the male portion.
Figure 3:
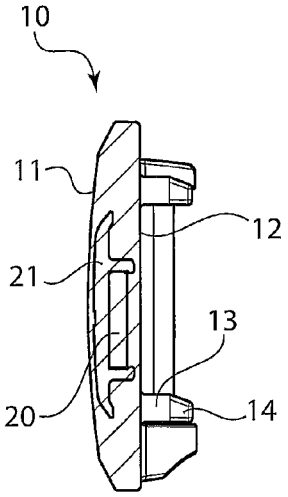
FIG. 3 shows a cross-sectional view of the male portion along lines III-III of FIG. 2.
Figure 10:
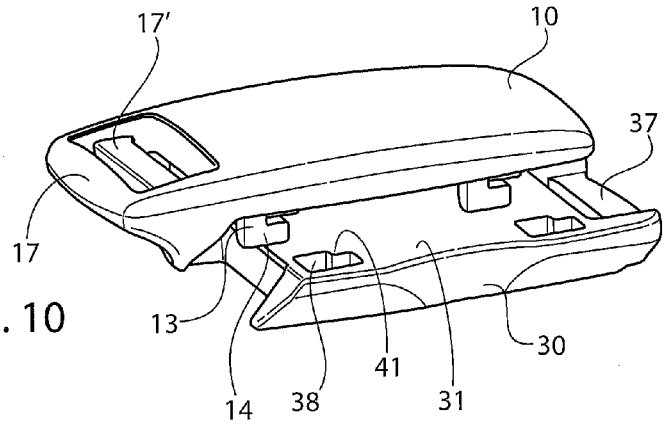
FIG. 10 shows the male and female portions being brought together.

Referring now in detail to the drawings, FIGS. 1-3 show the male portion 10 of the buckle assembly according to the invention. Male portion 10 has an outer surface 11, an inner surface 12, two longitudinally extending side edges 16 and 17, and two ends 18, 19. Extending from the inner surface are four locking legs 13, each having a horizontally extending locking pawl 14 at the respective ends thereof. At end 15 is disposed at least strap retaining bar 17, for retaining a length of webbing wrapped around strap retaining bar 17. An additional strap retaining bar 17' can also be used, such as shown in FIG. 10.

Embedded within male portion 10 is a magnet 20 held in place by a retainer 21, as shown in FIG. 3, and more fully described later with reference to FIGS. 6 and 7.

Figure 4:
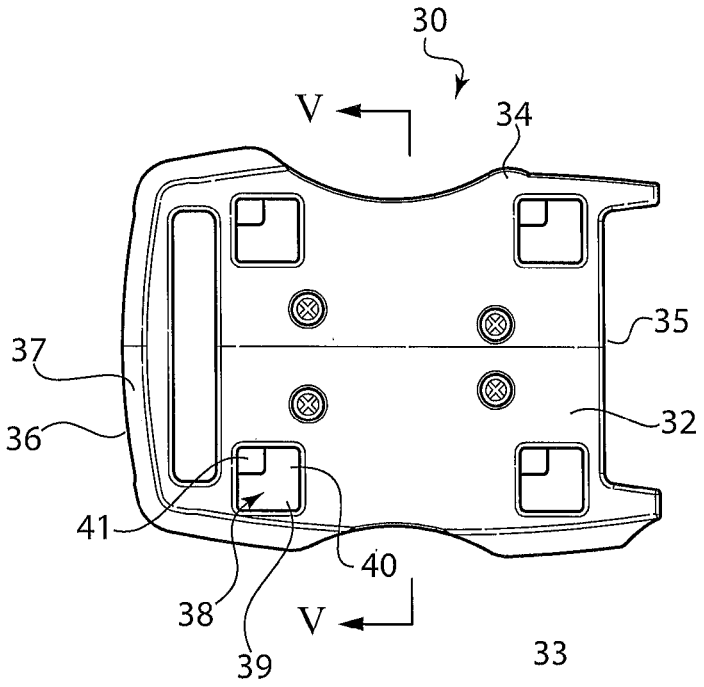
FIG. 4 shows a bottom view of the female portion of the buckle.
Figure 5:
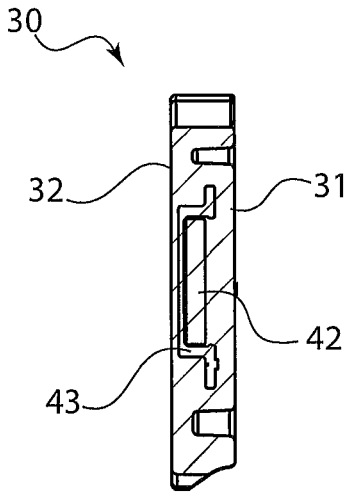
FIG. 5 shows a cross-section along lines V-V of FIG. 4.

FIGS. 4 and 5 show female portion 30 according to the invention. Female portion 30 comprises an inner surface 31, an outer surface 32, two longitudinally extending side edges 33, 34, two laterally extending ends 35 and 36. A strap retaining bar 37 is disposed at end 36 for retaining a length of webbing.

Disposed at the four corners of female portion 30 are four grooves 38 for receiving locking legs 13 of male portion 10. Each groove 38 has an insertion portion 39, shown as the lower half of each groove 38 in FIG. 4, and a locking portion 40, shown as the upper half of each groove 38. A locking flange 41 is disposed in insertion portion 39 and extends from the inner surface 31, but not fully down to outer surface 32.

A magnet 42 is embedded entirely within female portion 30. Magnet 42 is held inside a retainer 43, as described more fully with respect to FIGS. 8 and 9, below.

Figure 6:
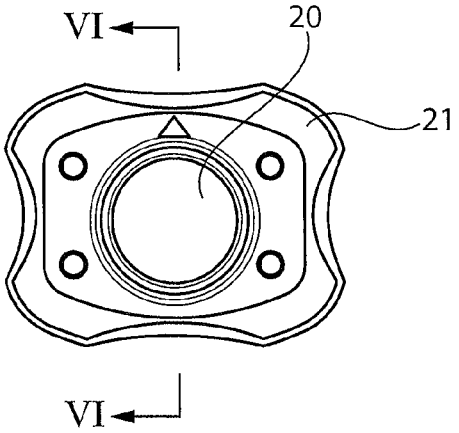
FIG. 6 shows a bottom view of the retaining element for the male portion.
Figure 7:
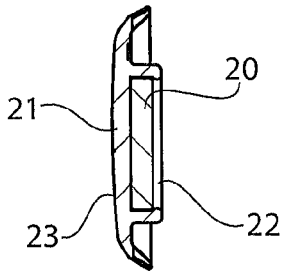
FIG. 7 shows a cross-section of the retaining element along lines VII-VII of FIG. 6.

FIGS. 6 and 7 show retainer 21 that is molded into male portion 10 according to the invention. Retainer 21 holds a circular magnet 20 in a slot 22 within retainer 21. Retainer 21 can be made of any suitable material, such as plastic or metal. Instead of a slot, retainer 21 can have legs or a flange that hold magnet 20 in place prior to molding within male portion 10. During the molding process, the upper surface 23 of retainer 21 can be exposed through male portion 10 or can be completely covered by the molding material used to form male portion 10.

Figure 8:
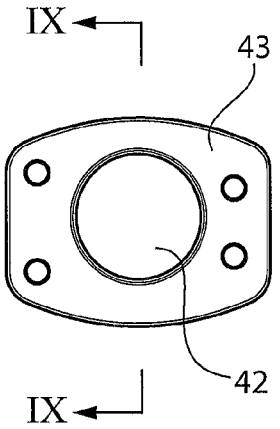
FIG. 8 shows a top view of the retaining element for the female portion.
Figure 9:
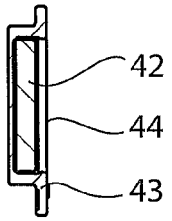
FIG. 9 shows a cross-sectional view along lines IX-IX of FIG. 8.

Similarly, FIGS. 7 and 8 show retainer 43 holding magnet 42 for molding into female portion 30. Magnet 42 can be held in a slot 44 or simply held in place by legs or flanges prior to molding into female portion 30. Retainer 43 can be made of any suitable material, such as metal or plastic. Magnet 42 can be round such as shown in FIG. 8 but can also be any other suitable shape.

Figure 11:
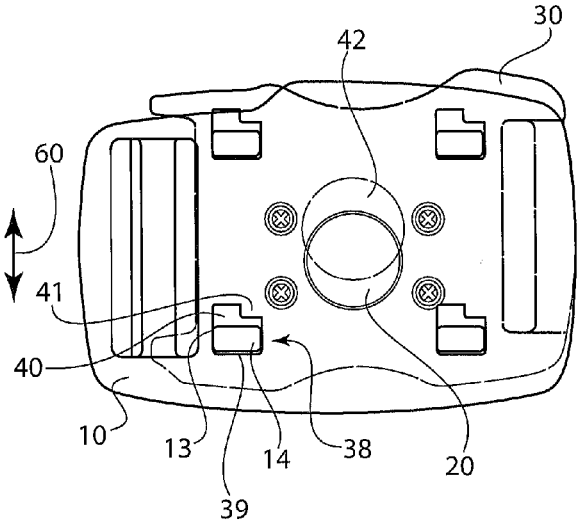
FIG. 11 shows a top view of the male portion with the locking legs inserted through the insertion slots of the female portion.
Figure 12:
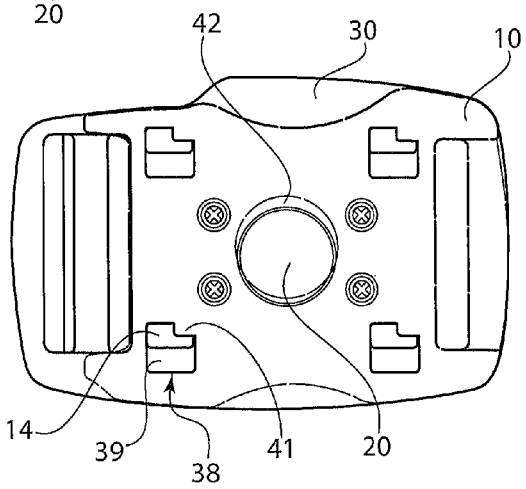
FIG. 12 shows a top view of the male and female portions in a fully locked position.

FIGS. 10-12 show the process of connecting male portion 10 to female portion 30. As shown in FIG. 10, male portion 10 is brought near female portion 30 so that the inner surface 12 of male portion 10 is facing inner surface 31 of female portion 30. The magnets 20, 42 (not shown in FIG. 10) are positioned so that opposite poles of the magnets 20, 42 face each other when the inner surfaces of the male and female parts are brought together. This way, the male portion 10 is attracted to the female portion 30. Once the magnetic attraction engages, the male and female portions 10, 30 are pulled together until locking legs 13 on male portion 10 are inserted through locking grooves 38 on female portion 30, as shown in FIG. 11. FIGS. 11 and 12 show male portion 10 being transparent for ease of illustration. In practice, male portion 10 can be transparent or opaque.

FIG. 11 shows the moment when locking legs 13 having locking pawls 14 extend through locking grooves 38 and reside in insertion portion 39 of locking grooves 38. At this point, magnets 20 and 42 are laterally misaligned and acting to pull male portion 10 and/or female portion 30 in a lateral direction as defined by arrows 60 until magnets 20 and 40 are congruent. This lateral movement is shown in FIG. 12, at which point locking pawls 14 engage flange 41 by sliding under flange 41 in locking portion 40 of groove 38. When this occurs, no further lateral or upward movement of the male and female portions is possible. By the engagement of locking pawls 14 under flange 41, it is not possible to lift male portion 10 off of female portion 30, even if the magnetic attraction is overcome by manual force. In addition, extreme tension on straps wrapped around strap retainers 17, 17' and 37 of male portion 10 and female portion 30 respectively cannot release the connection, so the buckle assembly is securely locked together. The only way to release the buckle assembly is to slide male and female portions 10, 30 in opposite lateral directions until locking leg 13 enters insertion portion 39, at which point locking pawl 14 is freed from flange 41. Then, the user can pry male portion 10 up off of female portion 30 until the magnetic attraction between the two portions is broken.

To assist in the release of the buckle assembly, one or both of the side edges 33, 34 of female portion 30 can be provided with indentations 48, as shown in FIGS. 11 and 12. This allows the user to find finger holds on the buckle assembly and also provides a ledge created by side edge 18 on male portion 10 to assist in prying male portion 10 up off of female portion 30. Side edge 18 can also be configured with a protrusion for this purpose as well.

As can be seen in FIG. 12, even in the fully locked position, magnets 20 and 42 are still slightly misaligned. This creates a constant pulling tension on male and female portions 10, 30 so that no play exists in locking groove 38, thus ensuring at tight lock between the two portions.

Figure 13:
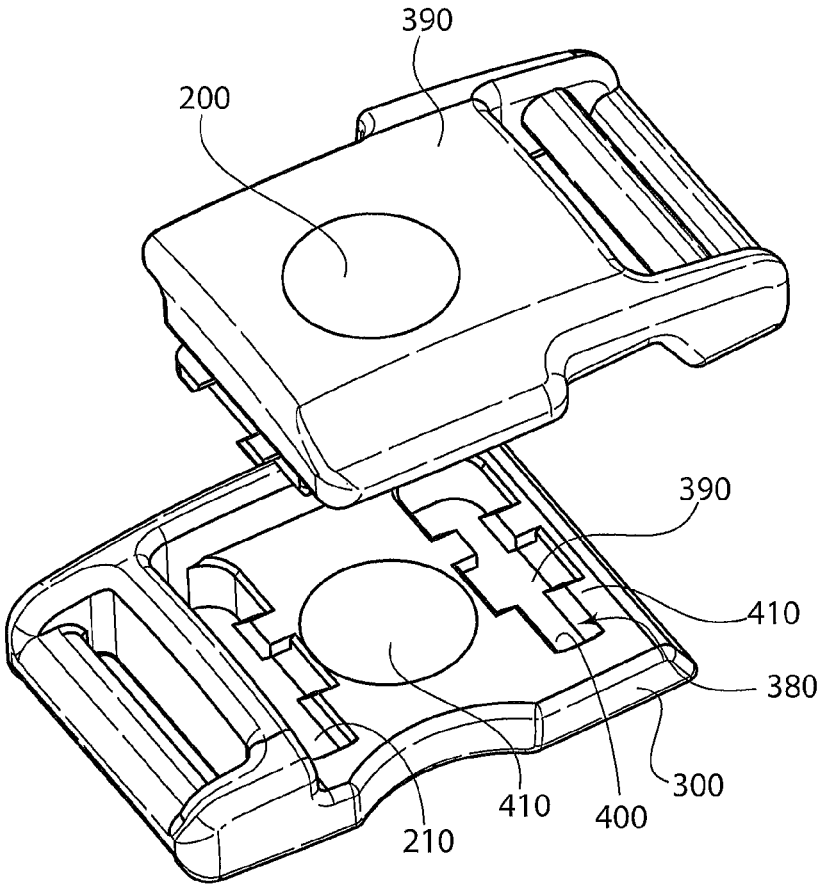
FIG. 13 shows a top view of an alternative embodiment of the buckle assembly according to the invention.
Figure 14:
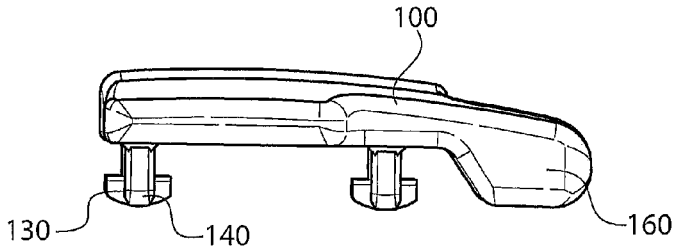
FIG. 14 shows a side view of the male portion of the embodiment of FIG. 13.
Figure 15:
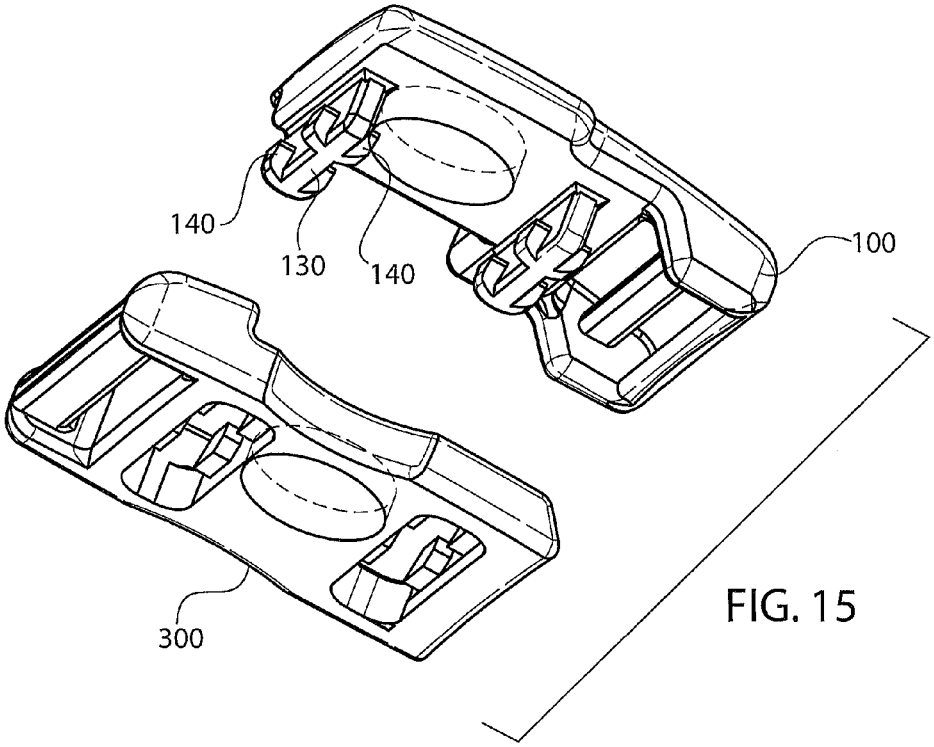
FIG. 15 shows a bottom view of the embodiment according to FIG. 13.

FIGS. 13-15 show an alternative embodiment of the buckle assembly according to the invention. In this embodiment, male portion 100 and female portion 300 interact in the same fashion as described above with respect to FIGS. 1-12. The difference in this embodiment is that instead of four individual locking legs 13, male portion 100 has two elongated locking legs 130, each with two locking pawls 140, as shown in FIGS. 14 and 15. Locking pawls 140 extend out on both sides of locking legs 130. In addition, side edge 160 is designed as protruding and covering the corresponding side edge of female portion 300 to provide an extra large finger hold for releasing the buckle parts from each other.

As shown in FIG. 13, female portion 300 has two large locking grooves 380, with two insertion portions 390 and two locking portions 400. Two sets of flanges 410 extend into locking portions 400 to cover locking pawls 140 when locking legs 130 are slid from insertion portions 390 to locking portions 400.

The operation of the buckle assembly shown in FIGS. 13-15 is identical to the operation of the buckle assembly shown in FIGS. 1-12. Magnets 200, 210 are embedded into the male portion 100 and female portion 300 in the same manner as with the buckle assembly of FIGS. 1-12. Moving male portion 100 near female portion 300 causes locking legs 130 to enter insertion portions 390 of locking grooves 380 and then slide laterally so that locking pawls 140 enter locking portions 400 and are held in place by flanges 410. The release is also the same as with the previous embodiment—the male and female portions are moved in opposite lateral directions until locking pawls 140 are freed from flanges 410 and enter insertion portions 390, at which point male portion 100 can be pried up off of female portion 300.

The present invention provides a simple and secure buckle assembly that can be locked together with minimal effort by the user. The placement of the magnets on the male and female portions ensure a secure and fail-safe locking between the male and female portions. The lateral offset of the magnets and the orientation of the locking grooves ensures that the buckle assembly cannot be inadvertently disengaged, even under torque or stress from the straps connected to the buckle portions.

Accordingly, while only embodiments of the present invention have been shown and described, it is obvious that many changes and modifications may be made thereunto without departing from the spirit and scope of the invention.

What is claimed is:

1. A buckle assembly comprising:

a male portion comprising:

an outer surface, an inner surface, two side edges and two ends, the side edges extending in a longitudinal direction and the ends extending in a lateral direction, a strap retaining bar disposed on one of the ends of the male portion, four locking legs projecting from the inner surface, each locking leg having a locking pawl extending from a distal end thereof, and a magnet disposed between the outer surface and the inner surface and being completely covered by the outer surface and inner surface, a female portion comprising:

an outer surface, an inner surface, two side edges and two ends, the side edges extending in a longitudinal direction and the ends extending in a lateral direction, a strap retaining bar disposed on one of the ends of the female portion, four locking grooves, each locking groove having an insertion portion extending through the inner surface, and a locking portion having a flange extending from the inner surface, the locking portion being disposed laterally adjacent the insertion portion, and a second magnet disposed between the inner and outer surfaces of the female portion and being completely covered by the inner and outer surfaces of the female portion, wherein placing the male portion adjacent the female portion causes the magnets to attract to each other to press the male portion to the female portion and force the locking legs through the insertion portion of the locking grooves, wherein the magnets are disposed laterally offset from each other when the locking leg extends through the insertion portion, so that the magnets to pull the male and female portions in opposing lateral directions to force the locking legs into the locking portions of the grooves, causing the locking pawls to engage the flanges and lock the male portion to the female portion.

2. The buckle assembly according to claim 1, wherein each of the magnets is disposed inside a retaining element and wherein the male and female portions are molded around the respective retaining elements.

3. The buckle assembly according to claim 2, wherein the retaining elements are made of metal.

4. The buckle assembly according to claim 1, wherein the strap retaining bars are disposed on opposite ends of the buckle assembly when the male and female portions are locked together.

5. The buckle assembly according to claim 4, wherein the ends of the male portion extend beyond the ends of the female portion when the male and female portions are locked together.

6. The buckle assembly according to claim 1, wherein one of the side edges of the male portion extends beyond the corresponding side edge of the female portion when the male and female portions are locked together.

7. The buckle assembly according to claim 6, wherein the corresponding side edge of the female portion is indented.

8. The buckle assembly according to claim 1, wherein when the male and female buckles are locked together, the magnets are disposed still offset from one another so as to apply constant lateral pressure on the male and female portions.

9. A buckle assembly comprising:

a male portion comprising:

an outer surface, an inner surface, two side edges and two ends, the side edges extending in a longitudinal direction and the ends extending in a lateral direction, a strap retaining bar disposed on one of the ends of the male portion, two locking legs, each locking leg extending laterally across the male portion at opposite longitudinal ends of the male portion, each locking leg having two locking pawls extending from a distal end thereof, and a magnet disposed between the outer surface and the inner surface and being completely covered by the outer surface and inner surface, a female portion comprising:

an outer surface, an inner surface, two side edges and two ends, the side edges extending in a longitudinal direction and the ends extending in a lateral direction, a strap retaining bar disposed on one of the ends of the female portion, two locking grooves, each locking groove extending laterally across the female portion and having two insertion portions extending through the inner surface, and two locking portions, each locking portion having a flange extending from the inner surface and being disposed laterally adjacent a respective one of the insertion portions, and a second magnet disposed between the inner and outer surfaces of the female portion and being completely covered by the inner and outer surfaces of the female portion, wherein placing the male portion adjacent the female portion causes the magnets to attract to each other to press the male portion to the female portion and force the locking legs through the insertion portions of the locking grooves, wherein the magnets are disposed laterally offset from each other when the locking legs extend through the insertion portions, so that the magnets to pull the male and female portions in opposing lateral directions to force the locking legs into the locking portions of the grooves, causing the locking pawls to engage the flanges and lock the male portion to the female portion.

* * * * *